US006129465A

United States Patent [19]

Hoyt et al.

[11] Patent Number: 6,129,465

[45] Date of Patent: Oct. 10, 2000

[54] RECEIPT DISCHARGING MECHANISM

[75] Inventors: Anthony Ross Hoyt, Lander, Wyo.; Robert Alexander Hoyt, Latham, N.Y.

[73] Assignee: Axiohm Transaction Solutions, Inc., Ithaca, N.Y.

[21] Appl. No.: 09/218,291

[22] Filed: Dec. 22, 1998

[51] Int. Cl.[7] ..... B65H 18/08

[52] U.S. Cl. ..... 400/578; 242/535.1

[58] Field of Search ..... 400/584, 585, 400/578, 585.1, 587, 588, 589, 594, 594.1, 605, 606, 613, 614, 614.1, 625; 101/288; 242/535.1

[56] References Cited

U.S. PATENT DOCUMENTS 4,218,032 8/1980 Nagel et al. ..... 242/535.1
4,494,706 1/1985 Becherer et al. ..... 242/535.1
4,504,026 3/1985 Serizawa et al. ..... 242/535.1
4,784,345 11/1988 Romanowski et al. ..... 242/535.1
5,879,090 3/1999 Hoyt et al. ..... 400/578

*Primary Examiner*—Stephen R. Funk
*Attorney, Agent, or Firm*—Salzman & Levy

[57] ABSTRACT

A receipt or media storage and presenting device is described that allows for the storage of various media, such as receipts, slips, forms, labels, tickets, tags, etc. The receipts are introduced into the device by an adjacent printer. The web of the receipt enters the storage and presenting device through an entrance guide, and thereafter is stored within a rib-cage storage bin. The device can store various lengths of the media up to about twenty feet. The device is then caused to rotate through an angle transverse of the printer discharge direction, which angle is preferably 90 degrees. Thereafter, the web of material is discharged through the guide mechanism that has pivoted 180 degrees from an initial entrance position to a discharge position.

5 Claims, 3 Drawing Sheets

RECEIPT DISCHARGING MECHANISM

FIELD OF THE INVENTION

This invention relates to receipt printing and handling devices and, more particularly, to a receipt presenting mechanism for printing a plurality of transactions upon a continuous web, temporarily storing the receipt web, and thereafter discharging the receipt web at an angle to the normal discharge direction.

RELATED PATENT APPLICATION

This application is related to U.S. patent application Ser. No. 08/965,710, filed Nov. 7, 1997 now U.S. Pat. No. 5,879,0900. It is meant to incorporate the teachings of the copending application in the present application, by way of reference.

BACKGROUND OF THE INVENTION

Retail establishments usually print receipts of sales transactions upon paper from a supply roll. Very often, a plurality of transactions causes the printing of a lengthy receipt document. The long document presents an unwieldy and unmanageable web that is both unsightly and cumbersome to handle. The lengthy receipt web often drapes awkwardly from the print register, interfering with the entering of additional transactions and summing of the final receipt total.

It would be desirable to provide a means by which the lengthy web can be temporarily contained until the completion of printing and cutting of the receipt.

It would also be advantageous to provide a device in which a long receipt, multiple tickets, labels, forms, etc., can be confined or contained (i.e., "buffered") before presentation.

It would additionally be a benefit to provide a mechanism wherein a lengthy receipt can be temporarily stored and thereafter discharged at a right angle to the normal discharge direction, so as not to interfere with the keyboard or face (display) of the register.

Like its aforementioned predecessor, the present invention seeks to provide a device that captures and temporarily stores a lengthy receipt web, as the transactions are printed and totalled, and the web is cut. The device then rotates through an angle of between approximately 0 to 90 degrees (preferably 90 degrees) from the normal web discharge direction, and issues the receipt. The apparatus may be oriented to allow rotation to the left or to the right, providing a presentation field of 180 degrees. In this manner, the front of a register is not encumbered by a long, suspended, receipt web.

The previous apparatus required that the stored loop of material be discharged utilizing a reverse loop in order that it be discharged. The mechanism that accomplished reversal of the paper was unnecessarily complex.

The present invention seeks to reduce the complexity inherent with the previous device. The current invention has now provided a new entrance and discharge guide mechanism. At an entrance guide, the mechanism is pivotally driven, so that when the angle of the presenter is changed, the entrance guide is pivoted 180°, and becomes a discharge guide. The stored paper is then dischargeable from the storage bin in a straight line, thus eliminating the previous reversal of direction. This mechanism provides a simple, less intricate design.

SUMMARY OF THE INVENTION

In accordance with the present invention, there is provided a presenting mechanism that stores and then discharges a printed receipt, label, ticket, or form at an angle to the issuing direction. The mechanism comprises an overflow bucket, of generally oval shape, that is disposed adjacent the exit slot of a receipt printer. The overflow bucket is mounted upon a rotatable assembly. The receipt is dispersed as a continuous web from the exit slot of the receipt printer. It then enters the overflow bucket through an entrance guide. A sensor disposed adjacent the entrance guide senses the web of paper and triggers a motor that drives a pair of feed rollers connected thereto by a gear train. The same sensor is used to detect the trailing edge of the receipt, in order to detect jams as well as to determine that the receipt has been successfully discharged. The feed rollers push the paper web into a rib-cage support disposed in the overflow bucket. The rib-cage supports the paper as it is stored within the bucket, and allows the web to flow smoothly thereupon.

Upon discharge from the overflow bucket, the feed rollers reverse direction and push the paper back out through the entrance guide. The feed rollers are mounted upon a gear drive that rotates and causes the discharge of the paper at a second position. A guide mechanism is provided for entering and discharging the web of material. After the web has entered the storage bin, the guide is pivotally driven, so that when the angle of the presenter is changed, the entrance guide is pivoted 180°, to become a discharge guide. The stored paper then discharges from the storage bin, and out through the discharge guide at the new presenter angle, with a straight line of discharge.

It is an object of the present invention to provide an improved discharging receipt device.

It is another object of this invention to provide a receipt discharge device having an improved entrance and discharge guide mechanism for storing and discharging a receipt.

BRIEF DESCRIPTION OF THE DRAWINGS

A complete understanding of the present invention may be obtained by reference to the accompanying drawings, when considered in conjunction with the subsequent detailed description, in which.

For purposes of clarity and brevity, like elements and like components shall each bear the same designation throughout the figures.

DESCRIPTION OF THE PREFERRED EMBODIMENT

Generally speaking, the invention features a receipt storage and presenting device. The device allows for the storage of various media, such as receipts, slips, forms, labels, tickets, tags, etc. The receipts are introduced into the device by an adjacent printer. The web of the receipt enters the storage and presenting device through an entrance guide. Thereafter, the receipt is stored within a rib-cage storage bin.

The device can store various lengths of media, up to about twenty feet. The device is caused to rotate through an angle transverse of the printer discharge direction, which angle is preferably ninety degrees. Thereafter, the web of material is discharged through the guide mechanism that has pivoted 180° from an initial entrance position, to a discharge position.

Figure 1:
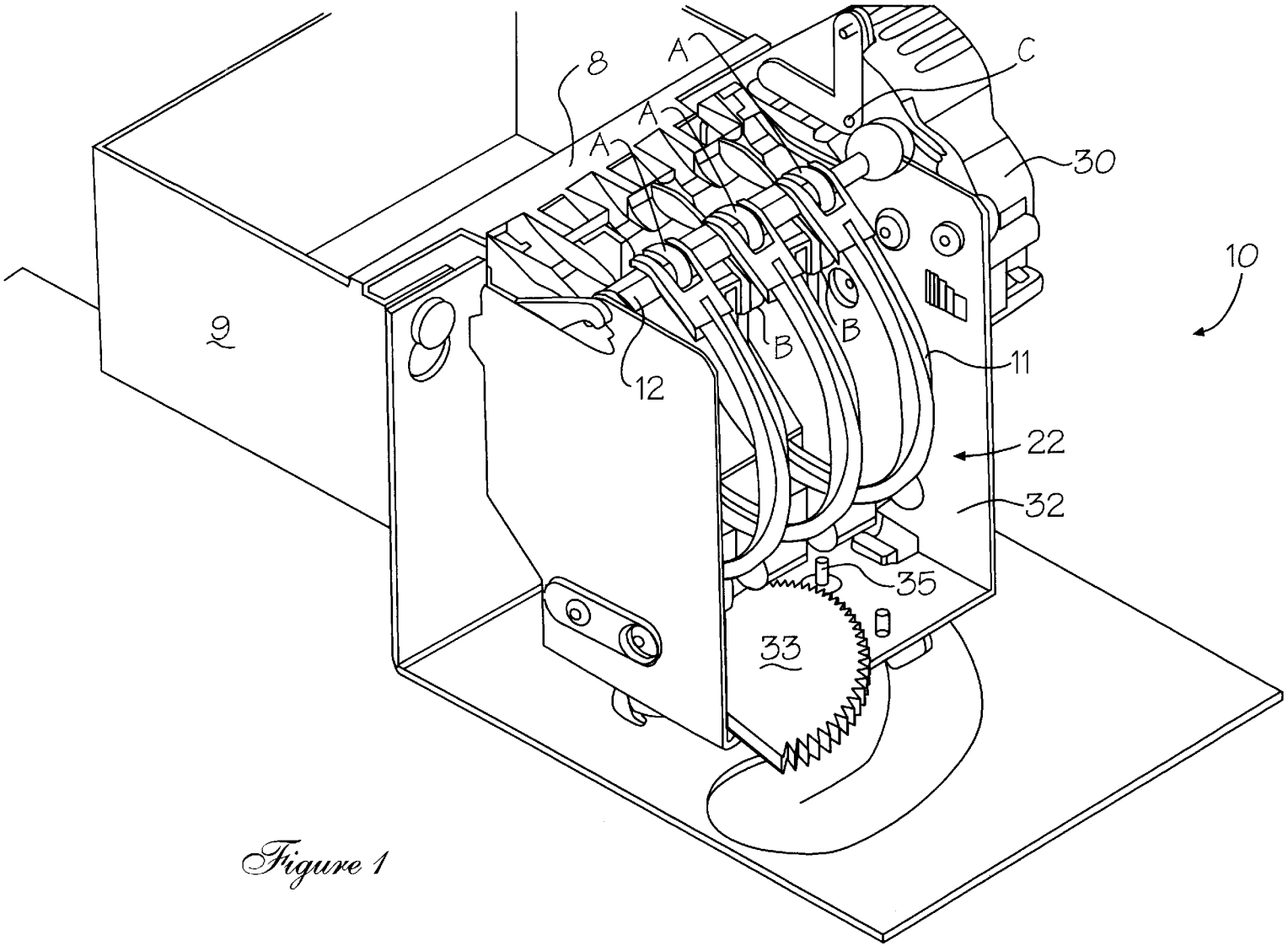
FIG. 1 illustrates a perspective, frontal view of the receipt storage and presenter device of the present invention, disposed at a receipt receiving position.
Figure 2:
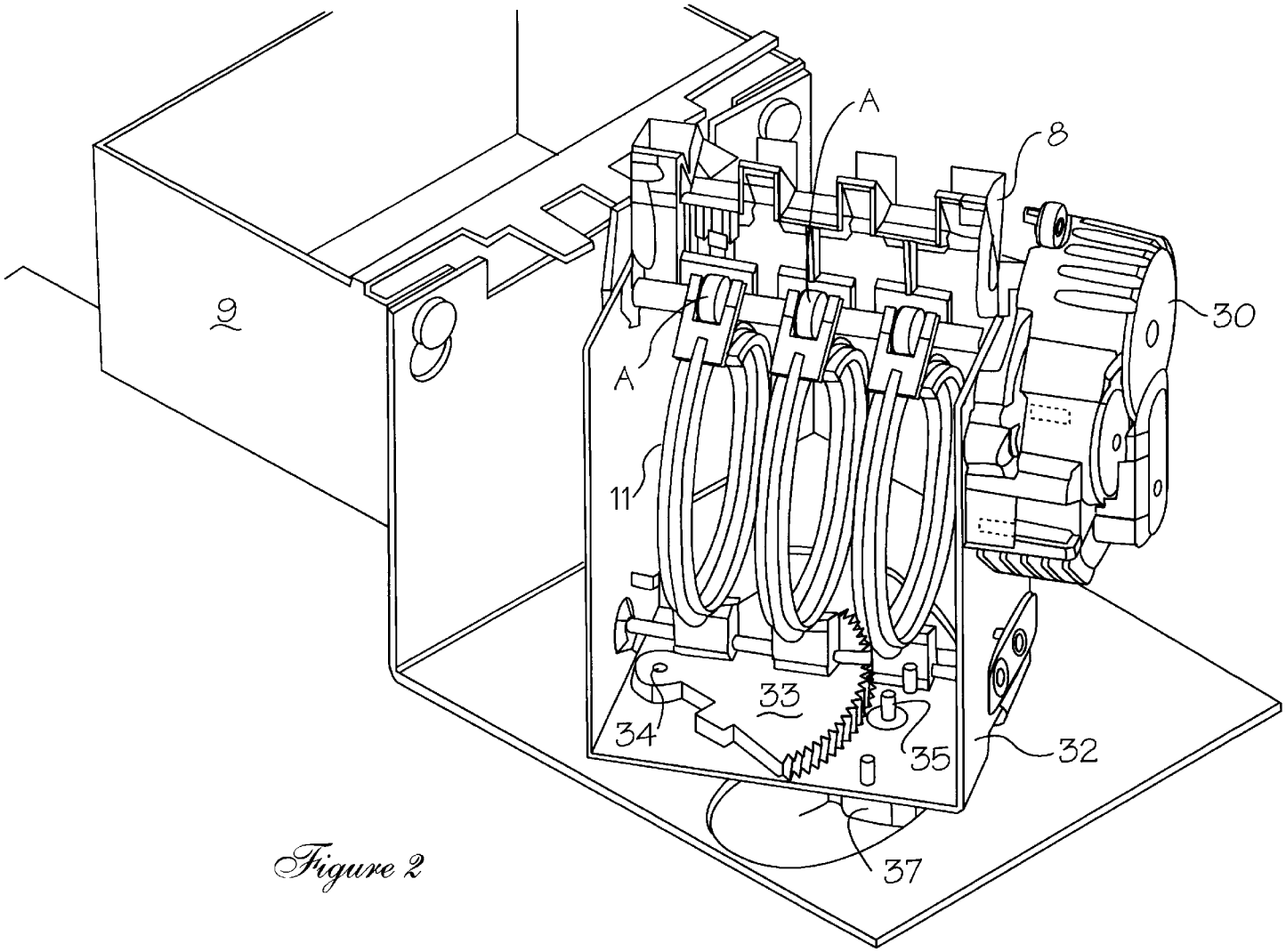
FIG. 2 depicts a perspective, frontal view of the receipt storage and presenter device of the invention disposed at an intermediate position between the receipt receiving position, illustrated in FIG. 1, and the receipt discharging position, shown in FIG. 3.
Figure 3:
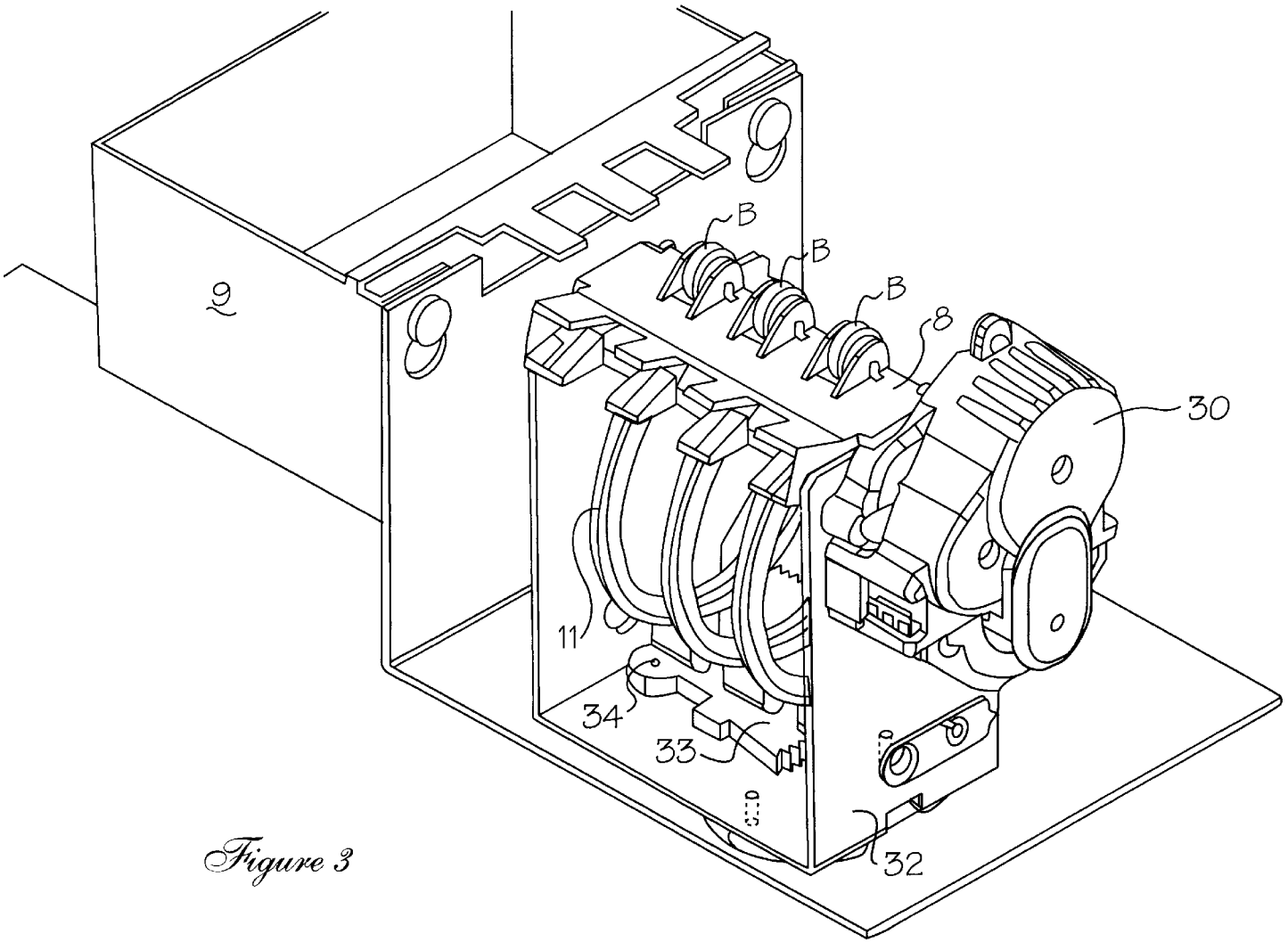
FIG. 3 shows a perspective, frontal view of the receipt storage and presenter device of FIG. 1 depicted at its receipt discharging position.

Now referring to FIGS. 1 through 3, a perspective view of the receipt storage and presenter device 10 and associated printer 9 is shown. The printer 9 discharges a receipt (not shown) to the storage bin 22 of the storage and presenting device 10 in FIG. 1. The storage bin has the configuration of a rib-cage, as previously described in copending U.S. patent application Ser. No. 08/965,710 now U.S. Pat. No. 5,879,090.

The slip or web representing the receipt is discharged by printer 9 through an entrance guide plate 8, as best observed in FIG. 3. The guide plate 8 guides the web through the nip of rollers "A" and "B". Rollers "A" are fixedly attached to rotative drive shaft 12, observed in the intermediate position, illustrated in FIG. 2. The complementary "B" rollers of the nip are rotatively fixed to the guide plate 8, as best observed in FIG. 3. The web enters the storage bin 22 under the influence of the drive shaft 12, which rotatively drives rollers "A". The web, entering the guide plate 8, is wound within the rib-cage 11.

A sensor (not shown), is disposed in front of rollers "A" and "B", and senses the presence of a receipt web as it enters the guide mechanism 8. The sensor generates a signal to actuate a motor (not shown) disposed in gear housing 30. The motor drives shaft 12 through a gear train in the housing 30. Upon web discharge, the motor direction is reversed to dispel the web from the storage bin 22 through guide mechanism 8.

Referring to FIG. 3, the receipt is presented (discharged) from the storage and presenting device 10 after having been stored therein. It will be observed that rollers "A" and "B" switch positions upon the guide plate 8. That is, rollers "B" are now disposed over rollers "A". The pivotal guide 8, is pivotal about pivot point "C" (FIG. 1). The motor in housing 30 drives the guide 8, which is connected to the motor by appropriate gearing.

The rollers "A" and "B", the entrance guide 8, and the gear train housing 30 are all supported upon a rotatable frame 32. Frame 32 is pivotally supported about shaft 34, illustrated in FIG. 2. The shaft 34 is connected to sectional gear 33, which is driven by spur gear (not shown), attached to shaft 35. The spur gear is rotatively driven by a drive motor 37 via connecting shaft 34. Pivoting the frame 32 allows the receipt to be discharged at an angle with respect to the incoming receipt direction, as shown in the intermediate position (FIG. 2). The preferred angle is 90 degrees, but the frame 32 can be pivotally directed about any angle from 0 to 90 degrees. Moreover, when the apparatus is adapted to rotate up to 90 degrees to the left and up to 90 degrees to the right, a presentation field of 180 degrees is obtained. The sensor (not shown) actuates motor 37 when the trailing edge of the web is sensed.

It should be understood that the presenter can be constructed in such a manner as to allow for varying widths of media. This can be done with a modular, building block approach, by which some parts and assemblies are used to build various width presenters. One presenter could also be constructed and used with two different print mechanisms or two similar mechanisms to alternately present different media (e.g., two color receipts from one unit and tickets or coupons from the other).

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. A media storage and presenting device, comprising:

storage means for receiving media material;

at least one pair of feed rollers for feeding the media material to said storage means, said pair of feed rollers being supported upon a pivotal guide;

rotative drive means for driving one of said at least one pair of feed rollers;

pivotal drive means for moving said pivotal guide from a media receiving position to a media discharging position; and second drive means attached to said storage means for moving said storage at an angle with respect to a feed direction.

2. The media storage and presenting device in accordance with claim 1, wherein said support means comprises a rib-cage storage bin.

3. The media storage and presenting device in accordance with claim 1, wherein said second drive means can move said storage means from approximately zero to ninety degrees with respect to a feed direction.

4. A receipt storage and presenting device for storage of various receipts, slips and forms that form a web of material, said web of material being introduced into the receipt storage and presenting device by an adjacent printer, said storage and presenting device comprising a pivotal guide, a movable support, and a rib-cage storage bin mounted thereto, said web of material entering the storage and presenting device through said pivotal guide, and thereafter being stored within said rib-cage storage bin, said device having means for moving said movable support through an angle transverse of a printer discharge direction, and thereafter discharging the web of material through said pivotal guide, and drive means supported upon said movable support for pivoting said pivotal guide approximately 180° from an initial entrance position to a discharge position.

5. A media storage and presenting device for storage of various media, such as receipts, slips, forms, labels, tickets and tags that form a web of material, said web of material being introduced into the media storage and presenting device by an adjacent printer, said storage and presenting device comprising a pivotal guide, a movable support, and a rib-cage storage bin mounted thereto, said web of material entering the storage and presenting device through said pivotal guide, and thereafter being stored within said rib-cage storage bin, said device having means for moving said movable support through an angle of approximately 90° transverse of a printer discharge direction, and thereafter discharging the web of material through said pivotal guide, and drive means supported upon said movable support for pivoting said pivotal guide approximately 180° from an initial entrance position to a discharge position.

* * * * *